US012382993B2

(12) United States Patent
Potter et al.

(10) Patent No.: US 12,382,993 B2
(45) Date of Patent: Aug. 12, 2025

(54) LIQUID TRANSPORT ELEMENT FOR A VAPOR PROVISION SYSTEM

(71) Applicant: NICOVENTURES TRADING LIMITED, London (GB)

(72) Inventors: Mark Potter, London (GB); Wade Tipton, Cambridge (GB); William Harris, Cambridge (GB); Christopher Rowe, Cambridge (GB); James Davies, Cambridge (GB); James Boonzaier, Cambridge (GB); Conor Devine, Cambridge (GB)

(73) Assignee: NICOVENTURES TRADING LIMITED, London (GB)

( * ) Notice: Subject to any disclaimer, the term of this patent is extended or adjusted under 35 U.S.C. 154(b) by 797 days.

(21) Appl. No.: 15/733,722

(22) PCT Filed: Mar. 15, 2019

(86) PCT No.: PCT/GB2019/050731
§ 371 (c)(1),
(2) Date: Oct. 5, 2020

(87) PCT Pub. No.: WO2019/193310
PCT Pub. Date: Oct. 10, 2019

(65) Prior Publication Data

US 2021/0145055 A1 May 20, 2021

(30) Foreign Application Priority Data

Apr. 4, 2018 (GB) ..... 1805510

(51) Int. Cl.
*A24F 40/44* (2020.01)
*A24F 40/10* (2020.01)
*A24F 40/42* (2020.01)

(52) U.S. Cl.
CPC ..... *A24F 40/44* (2020.01); *A24F 40/42* (2020.01); *A24F 40/10* (2020.01)

(58) Field of Classification Search
None
See application file for complete search history.

(56) References Cited

U.S. PATENT DOCUMENTS

| | | | | |
|---|---|---|---|---|
| 4,774,032 | A | 9/1988 | Coates et al. | |
| 9,289,014 | B2 * | 3/2016 | Tucker | H05B 3/34 |
| 10,201,185 | B2 * | 2/2019 | Bleloch | A61M 11/042 |
| 2014/0205272 | A1 * | 7/2014 | Midgette | A61L 9/037 392/395 |

(Continued)

FOREIGN PATENT DOCUMENTS

| | | | |
|---|---|---|---|
| CN | 105916399 | A | 8/2016 |
| KR | 20060026875 | A | 3/2006 |

(Continued)

OTHER PUBLICATIONS

WO-2015026081-A1 Translation.*

(Continued)

*Primary Examiner* — Oscar C Jimenez
(74) *Attorney, Agent, or Firm* — Merchant & Gould P.C.

(57) ABSTRACT

A liquid transport element for a vapor provision system includes a layer of wicking material and a layer of substrate material rolled together to form a spiral.

21 Claims, 7 Drawing Sheets

(56) References Cited

U.S. PATENT DOCUMENTS

| | | | | |
|---|---|---|---|---|
| 2015/0245669 | A1* | 9/2015 | Cadieux | A61M 15/06 131/329 |
| 2015/0320116 | A1 | 11/2015 | Bleloch et al. | |
| 2016/0000149 | A1* | 1/2016 | Scatterday | A24F 40/485 392/394 |
| 2017/0347714 | A1* | 12/2017 | Metz | H05B 3/48 |
| 2021/0161209 | A1* | 6/2021 | Tack | H05B 6/105 |
| 2022/0295602 | A1* | 9/2022 | Zhou | H05B 3/12 |

FOREIGN PATENT DOCUMENTS

| | | | | |
|---|---|---|---|---|
| RU | 2646557 | C2 | 3/2018 | |
| WO | WO-2015026081 | A1 * | 2/2015 | A24F 47/008 |
| WO | 2017001818 | A1 | 1/2017 | |
| WO | 2017202594 | A1 | 11/2017 | |

OTHER PUBLICATIONS

"International Preliminary Report on Patentability for Application No. PCT/GB2019/050731, completed on Oct. 15, 2020", 6 pages.
"International Search Report and Written Opinion received for PCT Patent Application No. PCT/GB2019/050731, mailed on Jun. 27, 2019".
"Office Action received for Korean Patent Application No. 10-2020-702808, mailed on Nov. 29, 2022", 14 pages.
"Search Report received for Russian Patent Application No. 2020132456, mailed on Mar. 23, 2021", 2 pages.

* cited by examiner

LIQUID TRANSPORT ELEMENT FOR A VAPOR PROVISION SYSTEM

PRIORITY CLAIM

The present application is a National Phase entry of PCT Application No. PCT/GB2019/050731, filed Mar. 15, 2019, which claims priority from GB Patent Application No. 1805510.3, filed Apr. 4, 2018, each of which is hereby fully incorporated herein by reference.

TECHNICAL FIELD

The present disclosure relates to vapor provision systems such as nicotine delivery systems (e.g. electronic cigarettes and the like).

BACKGROUND

Electronic vapor provision systems such as electronic cigarettes (e-cigarettes) generally contain a vapor precursor material, such as a reservoir of a source liquid containing a formulation, typically, but not always, including nicotine, from which a vapor is generated for inhalation by a user, for example through heat vaporization. Thus, a vapor provision system will typically comprise a vapor generation chamber containing a vaporizer, e.g. a heating element, arranged to vaporize a portion of precursor material to generate a vapor in the vapor generation chamber. As a user inhales on the device and electrical power is supplied to the vaporizer, air is drawn into the device through an inlet hole and into the vapour generation chamber where the air mixes with vaporized precursor material to form a condensation aerosol. There is an air channel connecting the vapor generation chamber and an opening in the mouthpiece so the air drawn through the vapor generation chamber as a user inhales on the mouthpiece continues along the flow path to the mouthpiece opening, carrying the vapor with it for inhalation by the user. Some electronic cigarettes may also include a flavor element in the flow path through the device to impart additional flavors. Such devices may sometimes be referred to as hybrid devices and the flavor element may, for example, include a portion of tobacco arranged in the air path between the vapor generation chamber and the mouthpiece so that vapor/condensation aerosol drawn through the devices passes through the portion of tobacco before exiting the mouthpiece for user inhalation.

For electronic cigarettes using a liquid vapor precursor (e-liquid) there is a risk of the liquid leaking. This is the case for liquid-only electronic cigarettes and hybrid devices (electronic cigarettes with tobacco or another flavor element separate from the vapor generation region). Liquid-based e-cigarettes will typically have a capillary wick for transporting liquid from within a liquid reservoir to a vaporizer located in the air channel connecting from the air inlet to the vapor outlet for the e-cigarette. Thus the wick typically passes through an opening in a wall that separates the liquid reservoir from the air channel in the vicinity of the vaporizer.

FIG. 1 schematically shows a cross-section of a portion of a conventional electronic cigarette in the vicinity of its vapor generation chamber 2, i.e. where vapor is generated during use. The electronic cigarette comprises a central air channel 4 through a surrounding annular liquid reservoir 6. The annular liquid reservoir 6 is defined by an inner wall 8 and an outer wall 10, which may both be cylindrical (the inner wall 8 separates the liquid reservoir 6 from the air channel, and so in that sense the inner wall 8 also defines the air channel). The electronic cigarette comprises a vaporizer 12 in the form of a resistive heating coil. The coil 12 is wrapped around a wick 14. Each end of the wick 14 extends into the liquid reservoir 6 through an opening 16 in the inner wall 8. The wick 14 is thus arranged to convey liquid from within the liquid reservoir 6 to the vicinity of the coil 12 by capillary action. During use an electric current is passed through the coil 12 so that it is heated and vaporizes a portion of liquid from the capillary wick 14 adjacent the coil 12 to generate vapor in the vapor generation chamber 2 for user inhalation. The vaporized liquid is then replaced by more liquid drawn being along the wick 14 from the liquid reservoir 6 by capillary action.

Because the reservoir inner wall 8 has openings 16 to allow liquid to be drawn out of the reservoir 6 to the vaporizer 12, there is a corresponding risk of leakage from this part of the electronic cigarette. Leakage is undesirable both from the perspective of the end user naturally not wanting to get the e-liquid on their hands or other items, and also from a reliability perspective, since leakage has the potential to damage the electronic cigarette itself, for example due to corrosion of components which are not intended to come into contact with the liquid.

To help minimize the risk of leakage from the openings 16 in the approach of FIG. 1, the size of the openings 16 should closely correspond to the size of the wick 14 so the wick in effect blocks the openings. Typically it will be desired for the wick to be slightly compressed where it passes through the openings 16 to help form this seal. If the openings 16 are too large for the wick 14, the resulting gaps between the wick and the inner walls of the respective openings can allow liquid to leak from the reservoir through these gaps. Conversely, if the openings 16 are too small for the wick, the wick may be unduly compressed, and this can impact its wicking ability and result in insufficient liquid being supplied to the vaporizer during use, which can give rise to overheating and undesirable flavors (drying out).

It is not straightforward to ensure there is a good match between the size of the openings 16 and the size of the wick 14 where it passes through the openings. For example, from a manufacturing perspective, electronic cigarettes are mass produced items and the openings themselves are often defined by how multiple components fit together, and this means manufacturing and assembly variations can impact how reliably the size of openings can be reproduced from device to device. What is more, the geometry of the wicks themselves can be variable. For example, a wick will often comprise a bundle of fibers twisted together, for example glass fibers or organic cotton fibers, and this naturally means the outer profile of the wick is subject to variation, both along its length, and from wick to wick. Consequently, with the approach of FIG. 1, it is not always possible to reliably achieve the desired degree of sealing between the wick 14 and the openings 60 in the wall 8 of the reservoir 6. This can result in some devices having an increased risk of leakage (where openings are too large relative to the wick) and some devices having an increased risk of insufficient wicking/dry-out (where openings are too small relative to the wick).

Various approaches are described herein which seek to help address or mitigate at least some of the issues discussed above.

SUMMARY

According to a first aspect of certain embodiments there is provided a liquid transport element for a vapor provision system comprising a layer of wicking material and a layer of substrate material rolled together to form a cylindrical spiral.

According to another aspect of certain embodiments there is provided a vapor provision system comprising: the liquid transport element of the above-mentioned first aspect of certain embodiments; a reservoir containing liquid for vaporization; and a vaporizer; wherein the liquid transport element is arranged to transport liquid from the reservoir to the vaporizer for vaporization to generate a vapor for user inhalation, and wherein the liquid transport element extends into the reservoir through an opening in the wall of the reservoir.

According to another aspect of certain embodiments there is provided liquid transport means for transporting liquid in a vapor provision system comprising a layer of wicking means and a layer of substrate means rolled together to form a cylindrical spiral.

According to another aspect of certain embodiments there is provided a method of assembling a liquid transport element for a vapor provision system, comprising: providing a layer of substrate material; providing a layer of wicking material; and rolling the layer of substrate material and the layer of wicking material together to form a cylindrical spiral.

It will be appreciated that features and aspects of the disclosure described herein in relation to the first and other aspects of the disclosure are equally applicable to, and may be combined with, embodiments of the disclosure according to other aspects of the disclosure as appropriate, and not just in the specific combinations described above.

BRIEF DESCRIPTION OF THE DRAWINGS

Embodiments of the disclosure will now be described, by way of example only, with reference to the accompanying drawings, in which.

DETAILED DESCRIPTION

Figure 1:
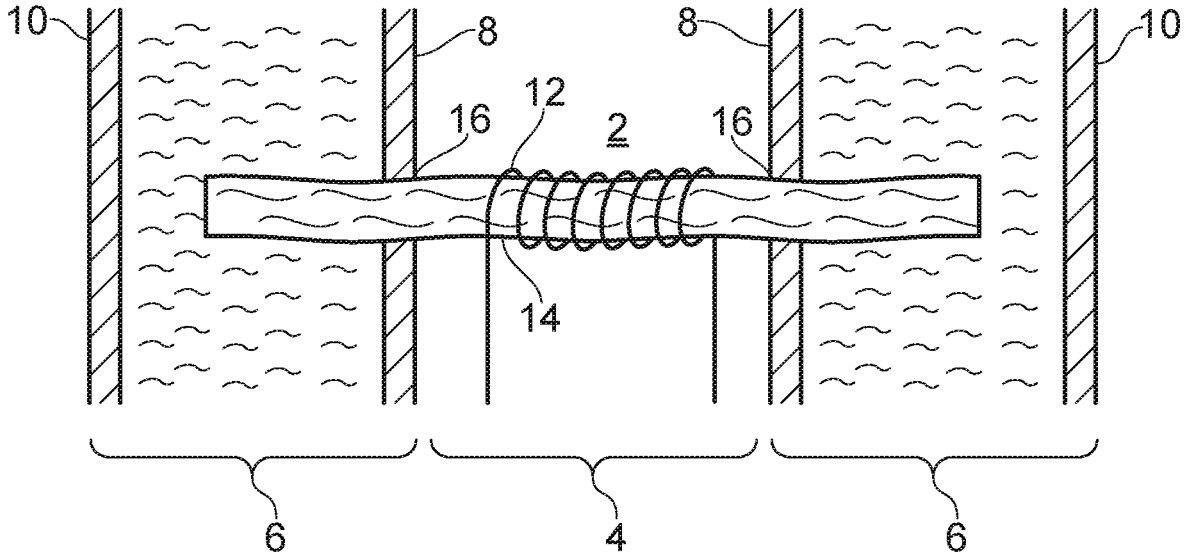
FIG. 1 represents in schematic cross-section a vapor generation region of a conventional vapor provision system.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to vapor provision systems, which may also be referred to as aerosol provision systems, such as e-cigarettes. Throughout the following description the term "e-cigarette" or "electronic cigarette" may sometimes be used, but it will be appreciated this term may be used interchangeably with vapor provision system/device and electronic vapor provision system/device. Furthermore, and as is common in the technical field, the terms "vapor" and "aerosol", and related terms such as "vaporize", "volatilize" and "aerosolize", may generally be used interchangeably.

Vapor provision systems (e-cigarettes) often, though not always, comprise a modular assembly including both a reusable part (control unit part) and a replaceable (disposable) cartridge part. Often the replaceable cartridge part will comprise the vapor precursor material and the vaporizer and the reusable part will comprise the power supply (e.g. rechargeable battery) and control circuitry. It will be appreciated these different parts may comprise further elements depending on functionality. For example, the reusable device part may comprise a user interface for receiving user input and displaying operating status characteristics, and the replaceable cartridge part may comprise a temperature sensor for helping to control temperature. Cartridges are electrically and mechanically coupled to a control unit for use, for example using a screw thread, latching or bayonet fixing with appropriately engaging electrical contacts. When the vapor precursor material in a cartridge is exhausted, or the user wishes to switch to a different cartridge having a different vapor precursor material, a cartridge may be removed from the control unit and a replacement cartridge attached in its place. Devices conforming to this type of two-part modular configuration may generally be referred to as two-part devices. It is also common for electronic cigarettes to have a generally elongate shape. For the sake of providing a concrete example, certain embodiments of the disclosure described herein will be taken to comprise this kind of generally elongate two-part device employing disposable cartridges. However, it will be appreciated the underlying principles described herein may equally be adopted for different electronic cigarette configurations, for example single-part devices or modular devices comprising more than two parts, refillable devices and single-use disposable devices, as well as devices conforming to other overall shapes, for example based on so-called box-mod high performance devices that typically have a more box-like shape. More generally, it will be appreciated certain embodiments of the disclosure are based on approaches for seeking to help more reliably form a seal for an opening in a reservoir wall through which a wick passes in accordance with the principles described herein, and other constructional and functional aspects of electronic cigarettes implementing approaches in accordance with certain embodiments of the disclosure are not of primary significance and may, for example, be implemented in accordance with any established approaches.

Figure 2:
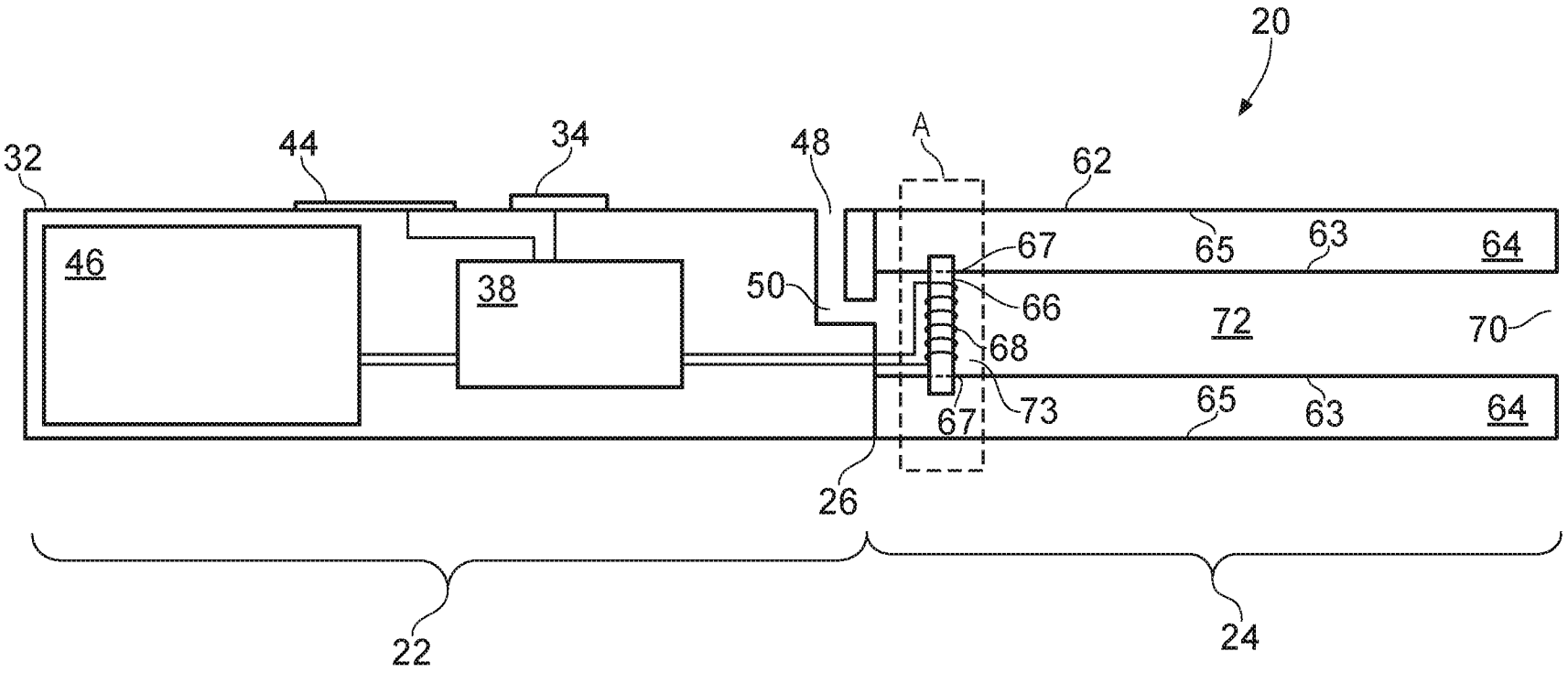
FIG. 2 represents in schematic cross-section a vapor provision system according to certain embodiments of the disclosure.

FIG. 2 is a cross-sectional view through an example e-cigarette 20 in accordance with certain embodiments of the disclosure. The e-cigarette 20 comprises two main components, namely a reusable part 22 and a replaceable/disposable cartridge part 24. In normal use the reusable part 22 and the cartridge part 24 are releasably coupled together at an interface 26. When the cartridge part is exhausted or the user simply wishes to switch to a different cartridge part, the cartridge part may be removed from the reusable part and a replacement cartridge part attached to the reusable part in its place. The interface 26 provides a structural, electrical and air path connection between the two parts and may be established in accordance with conventional techniques, for example based around a screw thread, latch mechanism or bayonet fixing with appropriately arranged electrical contacts and openings for establishing the electrical connection and air path between the two parts as appropriate. The specific manner in which the cartridge part 24 mechanically couples to the reusable part 22 is not significant to the principles described herein, but for the sake of a concrete example is assumed here to comprise a latching mechanism, for example with a portion of the cartridge being received in a corresponding receptacle in the reusable part with cooperating latch engaging elements (not represented in FIG. 2). It will also be appreciated the interface 26 in some implementations may not support an electrical and/or air path connection between the respective parts. For example, in some implementations a vaporizer may be provided in the reusable part rather than in the cartridge part, or the transfer of electrical power from the reusable part to the cartridge part may be wireless (e.g. based on electromagnetic induction), so that an electrical connection between the reusable part and the cartridge part is not needed. Furthermore, in some implementations the airflow through the electronic cigarette might not go through the reusable part so that an air path connection between the reusable part and the cartridge part is not needed.

The cartridge part 24 may in accordance with certain embodiments of the disclosure be broadly conventional apart from where modified in accordance with the approaches described herein in accordance with certain embodiments of the disclosure. In FIG. 2, the cartridge part 24 comprises a cartridge housing 62 formed of a plastics material. The cartridge housing 62 supports other components of the cartridge part and provides the mechanical interface 26 with the reusable part 22. The cartridge housing is generally circularly symmetric about a longitudinal axis along which the cartridge part couples to the reusable part 22. In this example the cartridge part has a length of around 4 cm and a diameter of around 1.5 cm. However, it will be appreciated the specific geometry, and more generally the overall shape and materials used, may be different in different implementations.

Within the cartridge housing 62 is a reservoir 64 that contains liquid vapor precursor material. The liquid vapor precursor material may be conventional, and may be referred to as e-liquid. The liquid reservoir 64 in this example has an annular shape which is generally circularly symmetric with an outer wall 65 defined by the cartridge housing 62 and an inner wall 63 that defines an air path 72 through the cartridge part 24. The reservoir 64 is closed at each end by end walls to contain the e-liquid. The reservoir 64 may be formed generally in accordance with conventional manufacturing techniques, for example it may comprise a plastics material and be integrally molded with the cartridge housing 62.

The cartridge part further comprises a wick (liquid transport element) 66 and a heater (vaporizer) 68. In this example the wick 66 extends transversely across the cartridge air path 72 with its ends extending into the reservoir 64 of e-liquid through openings 67 in the inner wall of the reservoir 64. As discussed further herein, in accordance with certain embodiments of the disclosure, the liquid transport element has the form of cylindrical spiral formed by rolling a layer of wicking material and a layer substrate together as discussed further herein.

The wick 66 and heater 68 are arranged in the cartridge air path 72 such that a region of the cartridge air path 72 around the wick 66 and heater 68 in effect defines a vaporization region 73 for the cartridge part. E-liquid in the reservoir 64 infiltrates the wick 66 through the ends of the wick extending into the reservoir 64 and is drawn along the wick by surface tension/capillary action (i.e. wicking) within the layer of wicking material in the wick, and, in some cases, also by capillary action in gaps between different turns of the cylindrical spiral structure forming the liquid transport element. The heater 68 in this example comprises an electrically resistive wire coiled around the wick 66. In this example the heater 68 comprises a nickel chrome alloy (Cr20Ni80) wire, but it will be appreciated the specific heater configuration is not significant to the principles described herein. In use electrical power may be supplied to the heater 68 to vaporize an amount of e-liquid (vapor precursor material) drawn to the vicinity of the heater 68 by the wick 66. Vaporized e-liquid may then become entrained in air drawn along the cartridge air path 72 from the vaporization region 73 towards the mouthpiece outlet 70 for user inhalation.

The rate at which e-liquid is vaporized by the vaporizer (heater) 68 will generally depend on the amount (level) of power supplied to the heater 68. Thus electrical power can be applied to the heater 66 to selectively generate vapor from the e-liquid in the cartridge part 24, and furthermore, the rate of vapor generation can be changed by changing the amount of power supplied to the heater 68, for example through pulse width and/or frequency modulation techniques.

The reusable part 22 may be conventional and comprises an outer housing 32 with an opening that defines an air inlet 48 for the e-cigarette, a battery 46 for providing operating power for the electronic cigarette, control circuitry 38 for controlling and monitoring the operation of the electronic cigarette, a user input button 34 and a visual display 44.

The outer housing 32 may be formed, for example, from a plastics or metallic material and in this example has a circular cross-section generally conforming to the shape and size of the cartridge part 24 so as to provide a smooth transition between the two parts at the interface 26. In this example, the reusable part has a length of around 8 cm so the overall length of the e-cigarette when the cartridge part and reusable part are coupled together is around 12 cm. However, and as already noted, it will be appreciated that the overall shape and scale of an electronic cigarette implementing an embodiment of the disclosure is not significant to the principles described herein.

The air inlet 48 connects to an air path 50 through the reusable part (control unit) 22. The reusable part air path 50 in turn connects to the cartridge air path 72 across the interface 26 when the reusable part 22 and cartridge part 24 are connected together. Thus, when a user inhales on the mouthpiece opening 70, air is drawn in through the air inlet 48, along the reusable part air path 50, across the interface 26, through the vapor generation region in the vapor generation region 73 in the vicinity of the atomizer 68 (where vaporized e-liquid becomes entrained in the air flow), along the cartridge air path 72, and out through the mouthpiece opening 70 for user inhalation.

The battery 46 in this example is rechargeable and may be of a conventional type, for example of the kind normally used in electronic cigarettes and other applications requiring provision of relatively high currents over relatively short periods. The battery 46 may be recharged through a charging connector in the reusable part housing 32, for example a USB connector (not shown).

The user input button 34, in this example is a conventional mechanical button, for example comprising a spring mounted component which may be pressed by a user to establish an electrical contact. In this regard, the input button may be considered an input device for detecting user input and the specific manner in which the button is implemented is not significant. For example, other forms of mechanical button(s) or touch-sensitive button(s) (e.g. based on capacitive or optical sensing techniques) may be used in other implementations.

The display 44 is provided to provide a user with a visual indication of various characteristics associated with the electronic cigarette, for example current power setting information, remaining battery power, and so forth. The display may be implemented in various ways. In this example the display 44 comprises a conventional pixilated LCD screen that may be driven to display the desired information in accordance with conventional techniques. In other implementations the display may comprise one or more discrete indicators, for example LEDs, that are arranged to display the desired information, for example through particular colors and/or flash sequences. More generally, the manner in which the display is provided and information is displayed to a user using the display is not significant to the principles described herein. For example, some embodiments may not include a visual display and may include other means for providing a user with information relating to operating characteristics of the electronic cigarette, for example using audio signaling or haptic feedback, or may not include any means for providing a user with information relating to operating characteristics of the electronic cigarette.

The control circuitry 38 is suitably configured/programmed to control the operation of the electronic cigarette to provide functionality in accordance with the established techniques for operating electronic cigarettes. For example, the control circuitry 38 may be configured to control a supply of power from the battery 46 to the heater/vaporizer 68 to generate vapor from a portion of the e-liquid in the cartridge part 24 for user inhalation via the mouthpiece outlet 70 in response to user activation of the input button 34, or in other implementations in response to other triggers, for example in response to detecting user inhalation. As is conventional, the control circuitry (processor circuitry) 38 may be considered to logically comprise various sub-units/circuitry elements associated with different aspects of the electronic cigarette's operation, for example user input detection, power supply control, display driving, and so on. It will be appreciated the functionality of the control circuitry 38 can be provided in various different ways, for example using one or more suitably programmed programmable computer(s) and/or one or more suitably configured application-specific integrated circuit(s)/circuitry/chip(s)/chipset(s) configured to provide the desired functionality.

The vapor provision system/electronic cigarette represented in FIG. 2 differs from conventional electronic cigarettes in the manner in which the liquid transport element/wick 66 is formed. In particular, in accordance with certain embodiments of the disclosure, and as noted above, the liquid transport element comprises a layer of wicking material and a layer of substrate material rolled together to form a cylindrical spiral (i.e. a "Swiss roll" shape). This is proposed to help with sealing the openings in the wall of the reservoir through which the wick passes. In particular, forming the wick using a rolled substrate material and wicking layer can help provide a wick with increased rigidity as compared to a conventional fibrous wick. This means the opening in the reservoir wall may be configured to press against the wick with a greater force than may be appropriate than for a conventional wick because the additional rigidity from the substrate layer reduces the risk of overly compressing the wick. Because of this, the nominal size of the opening may be made smaller than it might otherwise be for a conventional fibrous wick having the same diameter size as a rolled cylinder wick according to the principles described herein. It will be appreciated in other examples the spiral need not be in the form of a cylindrical spiral, but may, for example, be in the form of a spiral cone.

Figure 3:
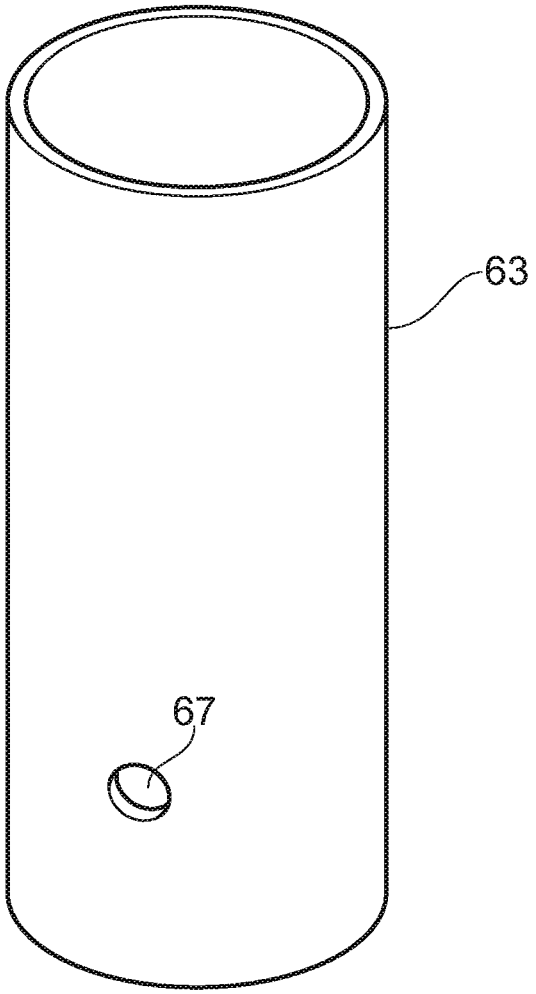
FIGS. 3 to 5 represent schematic perspective views of liquid reservoir wall configurations for vapor provision systems according to various embodiments of the disclosure.

FIG. 3 schematically represents one example approach for providing the inner wall 63 of the electronic cigarette 20 represented in FIG. 2. In this example the wall comprises a single piece tube with openings 67 in the appropriate places. In this example the openings 67 may be made by drilling through the tube comprising the inner wall 63 or by other means. The tube may, for example, be formed of a plastics material, a rubber material, e.g., silicone, glass or metal. During assembly the wick assembly may be threaded through the openings. In a variation on this approach, the inner wall 63 may comprise a slit on one side from one opening to the other. This slit may then be pulled open during assembly to allow the wick assembly to be slid into place, and then the slit closed when the wick assembly is in place. With this approach it may be appropriate to provide some form of sealing for the slit when the wick assembly is in place (e.g. adhesive tape over the slip).

Figure 4A:
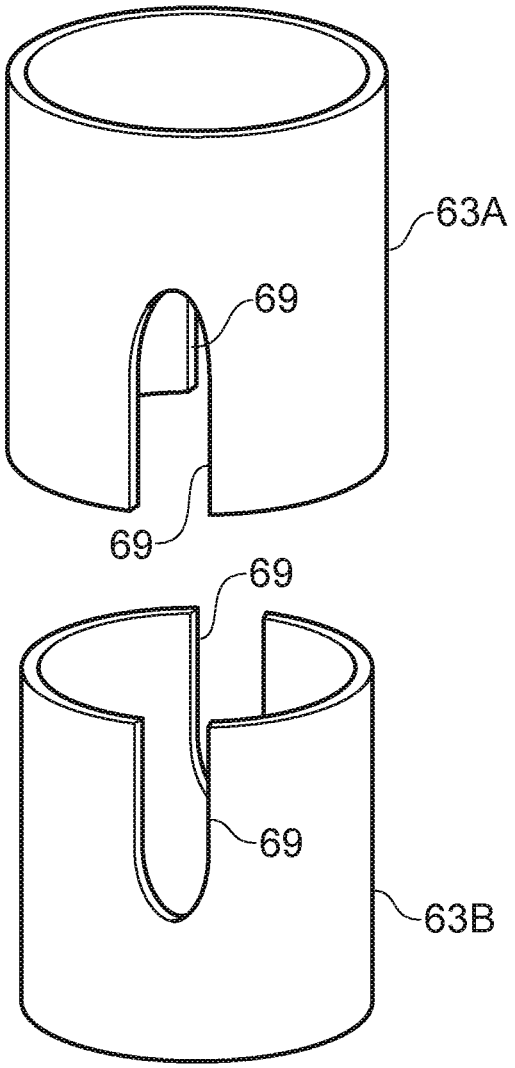
Figure 4B:
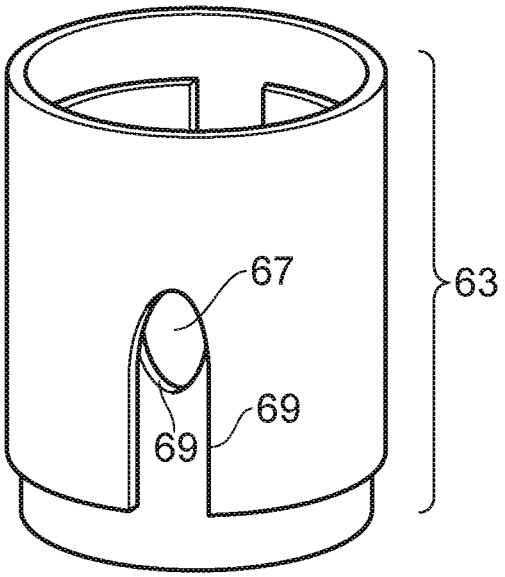

FIGS. 4A and 4B schematically represent another example approach for providing the inner wall 63 of the electronic cigarette 20 represented in FIG. 2. In this example the inner wall comprises two components, namely an upper component 63A and a lower component 63B. FIG. 4A schematically represents the upper and lower components when separated prior to assembly and FIG. 4B schematically represents the upper and lower components when coupled together for use in the electronic cigarette 20. The upper and lower components 63A, 63B are both in the form of a tube with the lower component being sized to provide an interference fit to the inside of the upper component so that they may be assembled as represented in FIG. 4B. As can be seen in the figures, each component has a pair of slots 69 which cooperate with the corresponding slots on the other component to form the openings 67 when assembled as seen in FIG. 4B. The inner wall components 63A, 63B may, for example, be formed of a plastics material, rubber, silicone, glass or metal, for example. During assembly the wick assembly may be simply located at the ends of the slots in one component before coupling to the other component.

Figure 5:
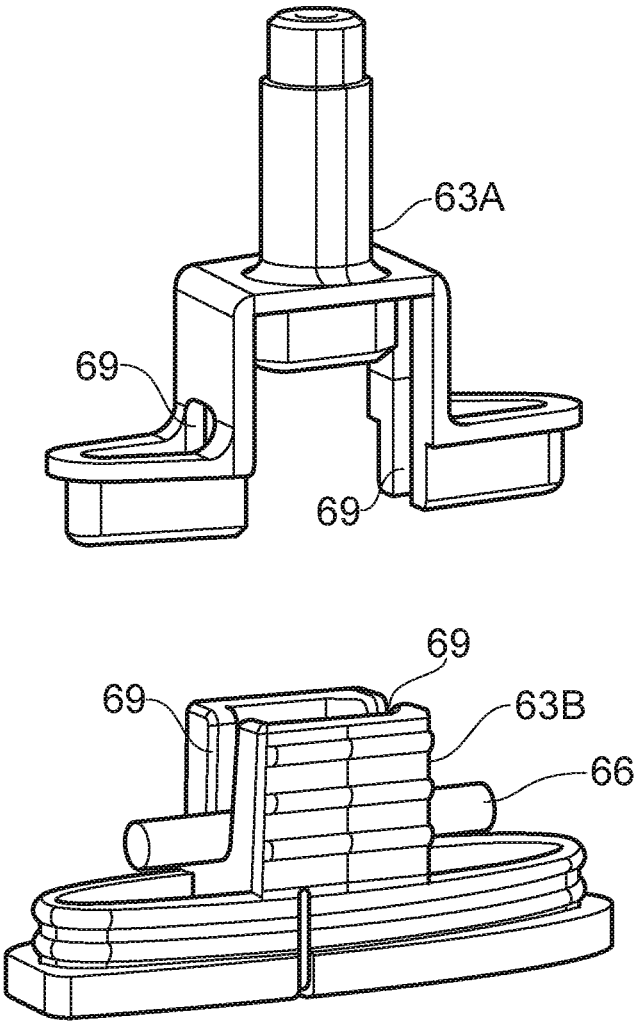

FIG. 5 schematically represents yet another example approach for providing the inner wall 63 of the electronic cigarette 20 represented in FIG. 2. The example represented in FIG. 5 is based on the same underlying principles as the example represented in FIGS. 4A and 4B, but differs in terms of the overall shape of the components. For example, the arrangement in FIG. 5 may be better suited to a relatively flat electronic cigarette rather than a generally tubular electronic cigarette. Thus, in the example of FIG. 5 the inner wall 63 is again provided by two components, namely an upper component 63A and a lower component 63B. FIG. 5 schematically represents the upper and lower components when separated prior to assembly. In this example the upper component 63A comprises a rigid structure, for example formed of a plastics material, and the lower component 63B comprises a resilient structure, for example formed of silicone. As for the example in FIGS. 4A and 4B, each component in FIG. 5 has a pair of slots 69 which cooperate with the corresponding slots in the other component to form openings when assembled. In FIG. 5 the wick 66 it shown in place in the lower component 63B. During assembly the wick may be simply located at the bottom of the slots in one component, such as shown in FIG. 5, before coupling to the other component.

In general, it will be appreciated the specific manner in which the inner wall 63 and its openings 67 are provided is not of primary significance to the principles described herein, and openings through which the wick extends where it enters the liquid reservoir may be provided differently in different implementations. Furthermore, it will be appreciated that whereas in the examples described herein the wick is assumed to have both ends extending into the liquid reservoir, it will be appreciated the same principles may be applied in respect of a wick having only one end extending into a liquid reservoir.

Example approaches for providing a wick (liquid transport element) in accordance with various different embodiments of the disclosure will now be described. Any of these approaches may be implemented in the example electronic cigarette 20 represented in FIG. 2, or indeed in any other form of electronic cigarette in which a liquid transport element extends into a liquid reservoir through a wall of the liquid reservoir.

Figure 6:
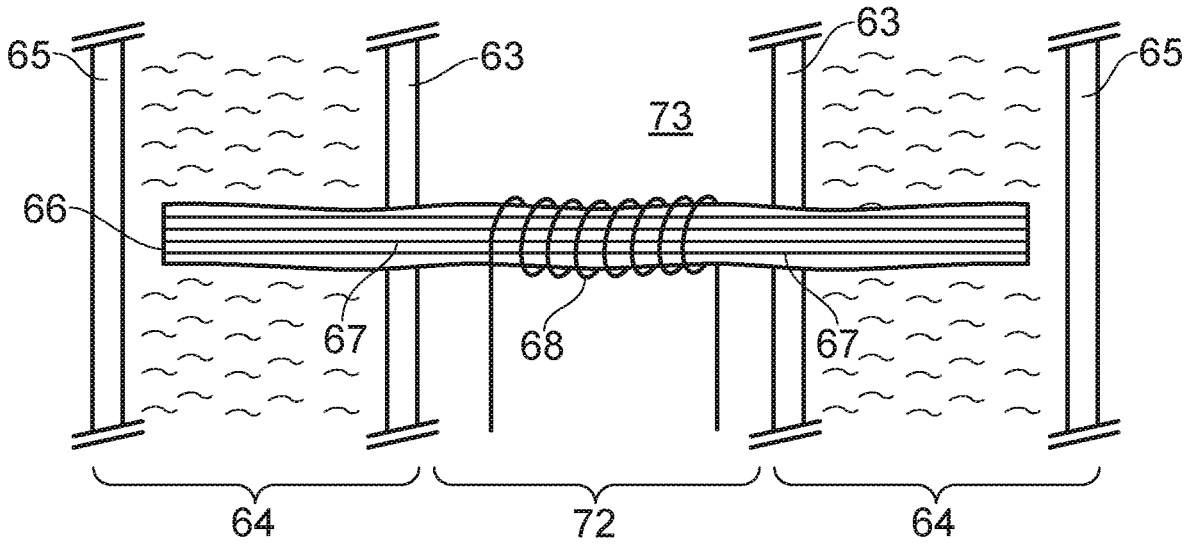
FIGS. 6 to 8 represent an approach for forming a liquid transport element (wick) for use in a vapor provision system according to an embodiment of the disclosure.

FIG. 6 schematically shows a cross-section of a portion of the electronic cigarette/vapor provision system 20 in the vicinity of its vapor generation chamber 73, i.e. where vapor is generated during use, in accordance with a first example embodiment. Broadly speaking, the portion of the electronic cigarette 20 represented in FIG. 6 corresponds to that part identified by the dashed-box labelled A in FIG. 2. Thus, and as represented in FIG. 6, this portion of the electronic cigarette 20 comprises sections of the outer wall 65, the inner wall 63, and the liquid reservoir 64, as well as the wick 66 and vaporizer (heating coil) 68. This portion of the electronic cigarette includes the part of the inner wall 63 comprising the openings 67 through which the wick 66 passes so that the ends of the wick extend into the liquid reservoir 64.

As noted above, in accordance with certain embodiments of the disclosure the wick (liquid transport element) 66 for the vapor provision system 20 comprises a layer of wicking material and a layer of substrate material rolled together to form a rolled spiral, which in some examples may be in the form of a cylinder. In this example outer periphery of the rolled spiral wick has a generally circular cross section. Because in accordance with the example approach represented in FIG. 6 the wick includes a rolled substrate material that can be more rigid than the wicking material (e.g. because it can be solid/semi-solid (such as an elastomer) rather than porous), the overall wick is more resistant to compression forces applied perpendicular to its axis of extent than a conventional wick comprising fibrous wicking material. This can allow the vapor provision system to be configured with a relatively tighter fit between the wick and openings 67 to help ensure reliable sealing while reducing the risk of overly compressing the wick.

For the sake of providing a concrete example, it is assumed for the implementation represented in FIG. 6 that the wick has a nominal diameter of 3 mm and a length of around 20 mm and comprises around three complete turns of the rolled layers of substrate and wicking materials. It is further assumed each of the layers of wicking material and substrate material has a thickness of around 0.2 mm (of course these layers do need to have the same thickness as one another, for example in one implementation the wicking material layer may have a thickness of around 0.5 mm and the substrate material may have a thickness of around 0.2 mm, which for the same number or turns in the spiral would result in a thicker wick). It will be appreciated the specific sizes may vary for different implementations. For example, in a relatively high power electronic cigarette that is able to generate a relatively large amount of vapor, a larger diameter wick (e.g. comprising more spiral turns and/or thicker layers) may be used to help maintain a sufficient supply of liquid to the vaporizer. Conversely, in a relatively low power electronic cigarette that generates a relatively small amount of vapor, a smaller diameter wick (e.g. comprising fewer spiral turns and/or thinner layers) may be considered more appropriate. In some embodiments a wick may have a length of between around 12 mm and around 35 mm and a diameter of between around 2 mm and 5 mm, but again, other sizes may be used in other examples.

The openings 67 in the inner wall 63 represented in FIG. 6 may be provided in accordance with any of the example approaches represented in FIG. 3 to 5, or indeed in accordance with any known approaches for providing a corresponding structural part in other electronic cigarette implementations. The openings 67 have a shape broadly matched to the outer profile of the wick 66 (i.e. in this example broadly circular), and may be sized to be slightly smaller than the outer size of the wick, for example by around 10% or so, such that the inner surface defining the openings 67 is pressed against the outer surface of the wick when the electronic cigarette is assembled to help form a reliable seal between them. Significantly, and as noted above, because the wick 66 is to some extent protected from compression by the substrate material, a relatively tight fit between the inner wall and the wick may be provided to help provide a reliable seal with a reduced risk of overly compressing the wick as compared to conventional approaches.

Apart from the modifications associated with the rolled spiral wick 66, the electronic cigarette 20 may be otherwise conventional, both in terms of its structural configuration and functional operation.

Figure 7:
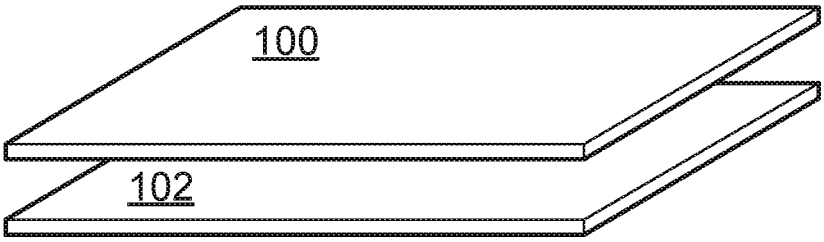
Figure 8:
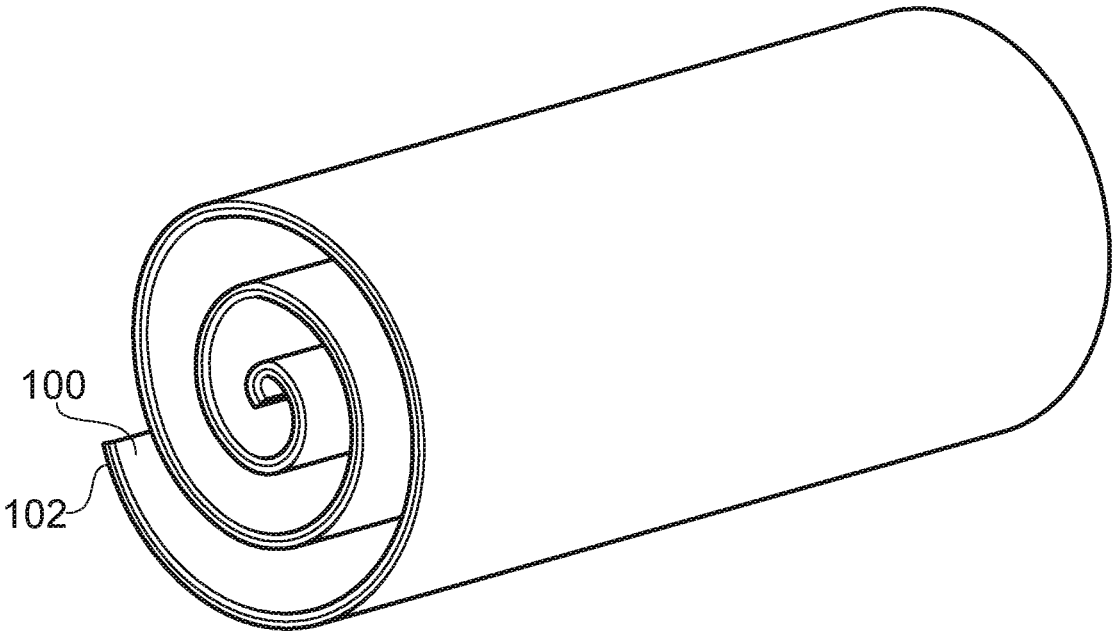
Figure 9:
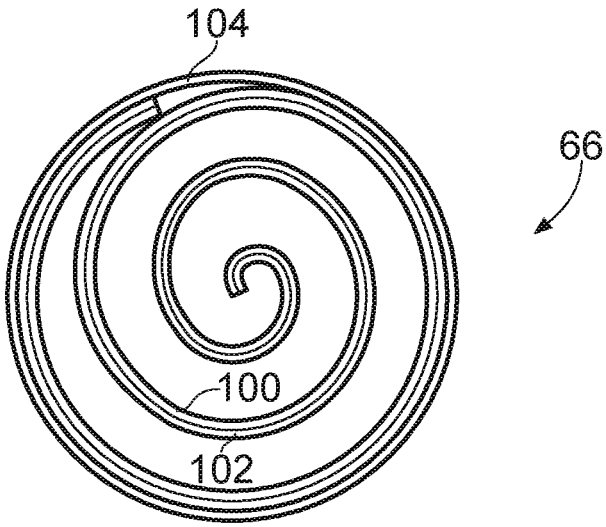
FIG. 9 represents in schematic cross-section a vapor generation region of a vapor provision system according to an embodiment of the disclosure.

FIGS. 7 to 9 schematically show an approach for providing a liquid transport element for use in a vapor provision system in accordance with certain embodiments of the disclosure. It should be noted these figures, and the relative dimensions of elements within the figures, are not to the same scale. For example, the layers 100, 102 in FIG. 7 are shown smaller than in FIGS. 8 and 9 and within each figure the layers are represented as being thinner compared to other dimensions in the figures than their assumed sizes for this example.

FIG. 7 schematically represents a perspective view of a planar layer of substrate material 102 and a planar layer of wicking material 100 before they are brought together for rolling to form a rolled spiral cylinder. FIG. 8 schematically represents in perspective view the layers of substrate material and wicking material after they have been brought together and rolled to form a spiral cylinder, in this example comprising around three complete turns. FIG. 9 schematically represents an end-on view of the rolled spiral cylinder formed by the layers of substrate material 102 and wicking material 100 and which further includes an outer sheath 104 arranged around the cylindrical spiral.

In this example the substrate material comprises a metal sheet or mesh, e.g. formed of steel, and potentially with an electrically insulating layer, e.g. an oxide layer. In other examples the substrate material may comprise other materials that are able to support the wicking material and withstand the temperature in the vicinity of the heater. In this example the wicking material comprises cotton. In other examples the wicking material may comprise other suitable materials, such as glass fiber. The respective layers in this example are similar in size and shape with each having a thickness of around 0.2 mm, an extent parallel to the axis about which the layers are rolled together of around 20 mm, and an extent perpendicular to the axis about which the layers are rolled together of around 20 mm (to accommodate around three spiral turns in this example) so the rolled spiral wick has a diameter of around 3 mm. However, and as already noted, it will be appreciated these values may vary for different implementations. For example, in other implementations the liquid transport may have an outer diameter anywhere from between 1 mm and 10 mm; between 1 mm and 7 mm or between 1 mm and 5 mm. Furthermore, in other implementations each layer may have a thickness of anywhere between 0.1 mm and 1 mm (the different layers may have different thicknesses). In other implementations the cylindrical spiral may has a length along its axis selected from the group comprising: between 5 mm and 35 mm; between 10 mm and 30 mm, and between 15 mm and 25 mm. Furthermore still, in other examples the cylindrical spiral may comprise a different number of complete turns, for example, more than 2, more than 3, more than 4, more than 5, more than 6, more than 7, more than 8, more than 9 or more than 10.

In some examples the layer of wicking material may be attached to the layer of substrate material before rolling. For example, the wicking material may be adhered to the substrate, in which case the wicking material may be built up by depositing wicking material directly on the substrate, e.g. in the form of separately adhered fibers. However, in other examples the layer of wicking material may comprise a self-supporting sheet that is simply placed adjacent to the substrate material and which may or may not be adhered to the substrate before they are rolled together.

The substrate material may be non-porous and in this case the substrate material may comprise one or more openings at locations along the length of the rolled spiral cylinder which are adjacent the vaporizer to facilitate the transport of liquid from the center of the wick 66 to its outer periphery for vaporization. However, in other examples there may be no such openings, and the transport of liquid from the center of the wick to the outer periphery may be only around the spiral path between the turns of the substrate material. In some cases the substrate material may be porous so that liquid can transfer outwards from the center of the wick towards its surface for vaporization.

In some examples the cylindrical spiral may be relatively tightly wound so that adjacent turns of the cylindrical spiral are in contact with one another, whereas in other examples the cynical spiral may be more loosely wound so that there are gaps between adjacent turns in the cylindrical spiral (e.g. as schematically shown in exaggerated form in FIG. 8). On the one hand, a tightly wound spiral may be expected to be more resilient to compression forces, thereby allowing for a tighter seal between the wick and openings in the reservoir wall. On the other hand, gaps between the turns may themselves support capillary transport along the wick. In examples where there are gaps between the turns of the spiral, the layer of substrate material may be configured to have greater rigidity (e.g. through choice of material or thickness) than might be the case if there were no gaps between the turns if greater rigidity is desired.

In some examples the substrate material may comprise a malleable material such that the spiral cylinder retains its form. In examples where the spiral cylinder does not retain its own form, it may be constrained to keep it spiral shaped by virtue of being held in the openings 67 in the wall of the reservoir, or it may have an outer sheath 104 applied to prevent the rolled spiral cylinder from unwinding, for example as schematically shown in FIG. 9.

The outer sheath 104 may, for example, comprise a metal sheet or mesh, e.g. formed of steel, and potentially with an electrically insulating layer, e.g. an oxide layer. The outer sheath may comprise a porous material so that liquid may pass from within the wicking material to the surface of the wick for vaporization. Alternatively, the sheath may comprise a non-porous material to help retain liquid within the wick. In this case there may be one or more gaps in the sheath at positions along the axis of liquid transport element that align with the vaporizer to allow liquid to be vaporized from the wicking material in the vicinity of the vaporizer.

While the above-described embodiments have in some respects focused on some specific example vapor provision systems, it will be appreciated the same principles can be applied for vapor provision systems using other technologies. That is to say, the specific manner in which various aspects of the vapor provision system function are not directly relevant to the principles underlying the examples described herein.

For example, whereas the above-described embodiments have primarily focused on aerosol provision systems comprising a vaporizer comprising a resistance heater coil, in other examples the vaporizer may comprise other forms of heater, for example a planar heater, in contact with a liquid transport element. Furthermore, in other implementations a heater-based vaporized might be inductively heated. In yet other examples, the principles described above may be adopted in devices which do not use heating to generate vapor, but use other vaporization technologies, for example piezoelectric excitement.

Furthermore, and as already noted, whereas the above-described embodiments have focused on approaches in which the aerosol provision system comprises a two-part device, the same principles may be applied in respect of other forms of aerosol provision system which do not rely on replaceable cartridge, example refillable or one-time use devices.

Thus there has been described a liquid transport element for a vapor provision system comprising a layer of wicking material and a layer of substrate material rolled together to form a cylindrical spiral. There has also been described a vapor provision system comprising the transport element; a reservoir containing liquid for vaporization; and a vaporizer; wherein the liquid transport element is arranged to transport liquid from the reservoir to the vaporizer for vaporization to generate a vapor for user inhalation, and wherein the liquid transport element extends into the reservoir through an opening in the wall of the reservoir.

The liquid transport element may, for example, be manufactured/assembled by: providing a layer of substrate material; providing a layer of wicking material; and rolling the layer of substrate material and the layer of wicking material together to form a cylindrical spiral.

The liquid transport element may be used in a tobacco industry product, for example a non-combustible aerosol provision system.

In one embodiment, the tobacco industry product comprises one or more components of a non-combustible aerosol provision system, such as a heater and an aerosolizable substrate.

In one embodiment, the aerosol provision system is an electronic cigarette also known as a vaping device.

In one embodiment the electronic cigarette comprises a heater, a power supply capable of supplying power to the heater, an aerosolizable substrate such as a liquid or gel, a housing and optionally a mouthpiece.

In one embodiment the aerosolizable substrate is contained in a substrate container. In one embodiment the substrate container is combined with or comprises the heater.

In one embodiment, the tobacco industry product is a heating product which releases one or more compounds by heating, but not burning, a substrate material. The substrate material is an aerosolizable material which may be for example tobacco or other non-tobacco products, which may or may not contain nicotine. In one embodiment, the heating device product is a tobacco heating product.

In one embodiment, the heating product is an electronic device.

In one embodiment, the tobacco heating product comprises a heater, a power supply capable of supplying power to the heater, an aerosolizable substrate such as a solid or gel material.

In one embodiment the heating product is a non-electronic article.

In one embodiment the heating product comprises an aerosolizable substrate such as a solid or gel material and a heat source which is capable of supplying heat energy to the aerosolizable substrate without any electronic means, such as by burning a combustion material, such as charcoal.

In one embodiment the heating product also comprises a filter capable of filtering the aerosol generated by heating the aerosolizable substrate.

In some embodiments the aerosolizable substrate material may comprise a vapor or aerosol generating agent or a humectant, such as glycerol, propylene glycol, triacetin or diethylene glycol.

In one embodiment, the tobacco industry product is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment, the hybrid system comprises a liquid or gel substrate and tobacco.

In order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention (s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other inventions not presently claimed, but which may be claimed in future.

The invention claimed is:

1. A liquid transport element and a vaporizer for a vapor provision system, wherein the liquid transport element comprises a layer of a wicking material and a layer of a substrate material rolled together to form a spiral and the vaporizer comprises an electrically powered resistance heater coil coiled around the liquid transport element.

2. The liquid transport element of claim 1, further comprising a sheath arranged around the spiral formed from the layer of the wicking material and the layer of the substrate material.

3. The liquid transport element of claim 2, wherein the sheath comprises a porous material.

4. The liquid transport element of claim 2, wherein the sheath includes one or more gaps at positions along an axis of the liquid transport element so that one or more portions of the spiral formed from the layer of the wicking material and the layer of the substrate material along the axis of the liquid transport element are not covered by the sheath.

5. The liquid transport element of claim 1, wherein the substrate material comprises a metallic or elastomeric material.

6. The liquid transport element of claim 1, wherein the substrate material is non-porous.

7. The liquid transport element of claim 1, wherein the substrate material comprises a malleable material.

8. The liquid transport element of claim 1, wherein the wicking material comprises at least one of cotton or glass fiber.

9. The liquid transport element of claim 1, wherein the wicking material comprises a fibrous material or a mesh material.

10. The liquid transport element of claim 1, wherein the layer of the wicking material is attached to the layer of the substrate material.

11. The liquid transport element of claim 1, wherein the spiral is wound so that adjacent turns of the spiral are in contact with one another.

12. The liquid transport element of claim 1, wherein the spiral is wound so that adjacent turns of the spiral are separated from one another.

13. The liquid transport element of claim 1, wherein the spiral comprises a number of complete turns selected from the group comprising: at least 2, at least 3, at least 4, at least 5, at least 6, at least 7, at least 8, at least 9, and at least 10.

14. The liquid transport element of claim 1, wherein the spiral has an outer diameter selected from the group comprising: between 1 mm and 10 mm; between 1 mm and 9 mm; between 1 mm and 8 mm; between 1 mm and 7 mm; between 1 mm and 6 mm; between 1 mm and 5 mm; between 1 mm and 4 mm; and between 1 mm and 3 mm.

15. The liquid transport element of claim 1, wherein the spiral has a length along its axis selected from the group comprising: between 5 mm and 35 mm; between 10 mm and 30 mm; and between 15 mm and 25 mm.

16. The liquid transport element of claim 1, wherein at least one of the layer of the wicking material or the layer of the substrate material has a thickness of between 0.1 mm and 1 mm.

17. A vapor provision system comprising:

the liquid transport element and the vaporizer of claim 1; and a reservoir containing liquid for vaporization, wherein the liquid transport element is arranged to transport the liquid from the reservoir to the vaporizer for vaporization to generate a vapor for user inhalation, and wherein the liquid transport element extends into the reservoir through an opening in a wall of the reservoir.

18. The vapor provision system of claim 17, wherein the opening in the reservoir wall is smaller than an outer size of the liquid transport element so that the reservoir wall around the opening applies a biasing force to the liquid transport element.

19. The vapor provision system of claim 18, wherein the vapor provision system is a cartridge configured to be coupled to a vapor provision system control unit for use.

20. Liquid transport means for transporting liquid in an electrically powered vapor provision system comprising:

a layer of wicking means and a layer of substrate means rolled together to form a spiral.

21. A method of assembling a liquid transport element for an electrically powered vapor provision system, comprising:

providing a layer of a substrate material;

providing a layer of a wicking material; and rolling the layer of the substrate material and the layer of the wicking material together to form a spiral.

* * * * *